United States Patent [19]

Honczarenko

[11] Patent Number: 4,681,275

[45] Date of Patent: Jul. 21, 1987

[54] TRAVERSING MECHANISM CONTROL

[75] Inventor: Art Honczarenko, Wayne, N.J.

[73] Assignee: Progressive Machine Co., Inc., Patterson, N.J.

[21] Appl. No.: 790,068

[22] Filed: Oct. 22, 1985

[51] Int. Cl.[4] ..... B65H 54/10; B65H 54/32

[52] U.S. Cl. ..... 242/67.1 R; 242/158 B; 242/158 R; 242/DIG. 2

[58] Field of Search ..... 242/67.1 R, DIG. 2, 242/158 B, 158 R

[56] References Cited

U.S. PATENT DOCUMENTS

| | | | |
|---|---|---|---|
| 3,029,649 | 4/1962 | Steyh | 242/158 B X |
| 3,400,594 | 9/1968 | Steyh | 242/158 B |
| 3,433,434 | 3/1969 | Latter | 242/158 R |
| 4,215,831 | 8/1980 | Williams | 242/DIG. 2 X |
| 4,453,678 | 6/1984 | Andonov et al. | 242/158 B X |

FOREIGN PATENT DOCUMENTS

| | | | |
|---|---|---|---|
| 2300386 | 1/1972 | Fed. Rep. of Germany | 242/158 B |

*Primary Examiner*—Stuart S. Levy
*Assistant Examiner*—Thomas R. Hannon
*Attorney, Agent, or Firm*—Stephen E. Feldman

[57] ABSTRACT

A spindle is driven in continuous manner to wind a ribbon of material upon a core. A traversing guide, moved in a side to side reciprocatory manner by a traversing carriage, guides the ribbon of material so that it is wound in spiral fashion upon the core to form a layer first in one direction and then in the opposite direction one upon the other until a package is formed.

A sensor wheel, attached to the spindle drive shaft for rotation therewith, is provided with a number of fingers the movement of which is sensed by a sensor head to provide digital pulses to a two stage counter. The two stage counter, in turn, controls activation and deactivation of solenoid valves to clutch and de-clutch the traversing carriage to a drive belt and provide the reciprocatory movement for the carriage and ribbon. By providing two stage control a dwell is provided for each direction of reversal for the traversing carriage during which it is not clutched to the timing belt for movement therewith and afterwards it is so clutched but for movement in a direction opposite to its previous direction of movement. By selecting the number of increments of rotation for the spindle during the respective periods of dwell and traverse side edges for the package of stability and appearance can be constructed.

10 Claims, 2 Drawing Figures

TRAVERSING MECHANISM CONTROL

BACKGROUND OF THE INVENTION—FIELD OF APPLICATION

This invention relates to traversing mechanisms; and more particularly, to control mechanisms for traversing mechanisms.

BACKGROUND OF THE INVENTION—DESCRIPTION OF THE PRIOR ART

The continuous layer winding of tapes (whether they be textile or of extruded plastic) ribbon, wire and other materials quite often involves creating a package of such material upon a core that is relatively much longer, in an axial direction, then the width of material being packaged upon the core. As such the material is wound upon the core in spiral tape layers with each layer including a number of turns (or widths) of the material. Such a layering process would proceed in a continuous manner, from proximate one axial side of the core to proximate the other axial side of the core and so on back and forth, until the desired amount of material is layered upon the core to form the package. The narrower the relative width of the material to be packaged the more often it appears necessary to form packages thereof in this manner.

Such layer packaging of narrow width, ribbon-like, materials may occur as manufacture of the ribbon of materials is completed; or it may be accomplished to make packages of predetermined lengths of material from bulk supplies of the material accumulated in other convenient configurations. Conventionally available machinery, for accomplishing layer packaging of ribbon like materials, usually includes a traversing carriage or body that is moved in reciprocatory manner between two end positions. The end positions in many instances may be operator selected to correspond to the width of the core upon which the material is to be layered. Some form of control is usually provided to effect a reversal of the traversing carriage when it reaches each end position.

However, such conventionally available machinery, for accomplishing layer packaging of ribbon-like material, like the machinery shown and described in U.S. Pat. No. 3,029,649 granted to Joseph Steyh on Apr. 17, 1962 for Traversing Mechanism and in U.S. Pat. No. 3,400,594 granted to Joseph Steyh on Sept. 10, 1968 for Traversing Mechanism, may create packages with ragged edges that would appear to the prospective purchaser as lacking quality. In addition, a package with a ragged edge might also collapse during shipment or in further use. Whenever such a collapse occurs it would render the material either more difficult to use or impossible to use. Such a ragged edge generally results when the traversing carriage changes direction and in doing so effects a change of direction of the material being layered. In the mechanisms of the patents the change of direction of the traversing body is effected only in response to the traversing body having reached a pre-set position of each end of its reciprocatory travel. Thus, it is without any reference to the position of the core upon which material is being layered and instead is based upon presumptions of position and condition which may not be accurate. In addition, other available traversing mechanism controls effect their respective control by employing undesirable mechanical type devices with fixed relationships such as cams and relatively complicated and expensive microprocessor controls.

SUMMARY OF THE INVENTION

It is therefore an object of this invention to provide a new and improved control for traversing mechanisms.

It is another object of this invention to provide a new and improved digital type control for traversing mechanisms.

it is yet another object of this invention to provide a new and improved traversing mechanism with digital controls.

It is still another object of this invention to provide a new and improved traversing mechanism.

It is yet still another object of this invention to provide a new and improved control mechanism for a traversing mechanism utilized to layer relatively narrow material onto a core to form a package of the material.

It is a further object of this invention to provide a new and improved digital control mechanism to control the formation of a package of ribbon-like material upon a core by a traversing mechanism normally utilized for such purposes.

This invention involves traversing mechanisms for effecting a guide of ribbon-like material being layered upon a core in spiral fashion and which guides the movement of the material along the axis of rotation of the core to so form the spiral, first in one direction and then in the other, to form successive layers of material into a package; and contemplates providing a digital type control to effect reversals in direction of travel of mechanism, which control is responsive to rotation of the core upon which the material is being layered and also provides for rotation of the core and layering of material without traverse for predetermined degree of rotation to build a package edge of desired configuration.

DESCRIPTION OF THE PREFERRED EMBODIMENT

For convenience, the invention will be described as applied to equipment and machinery for forming a package of cloth ribbon material, wherein the ribbon material is relatively narrow and a predetermined continuous length thereof is wound in spiral fashion upon a cylindrical cardboard core, with a number of turns of material forming each layer of the package and the layers being disposed one upon the other until the package is formed. The equipment or machinery includes an electrical motor driven spindle, for rotating the core, and a traversing carriage driven in reciprocatory manner from side to side by a combination of timing belts with solenoid actuated air powered controls. Electric micro-switches are utilized to facilitate actuation of the solenoids and stop the resultant traversing carriage reciprocation should absolute ends of permitted travel be reached. It should be understood, nevertheless, that without departing from the invention that the material to be wound may be of plastic or other substance and that it may be ribbon or otherwise ribbon-like. The material may be wound upon a core of any convenient configuration and made from plastic or other suitable substance. Reciprocatory movement of the traversing carriage may be accomplished by other than timing belts controlled by other than air, solenoids, and electric micro-switches.

Figure 1:
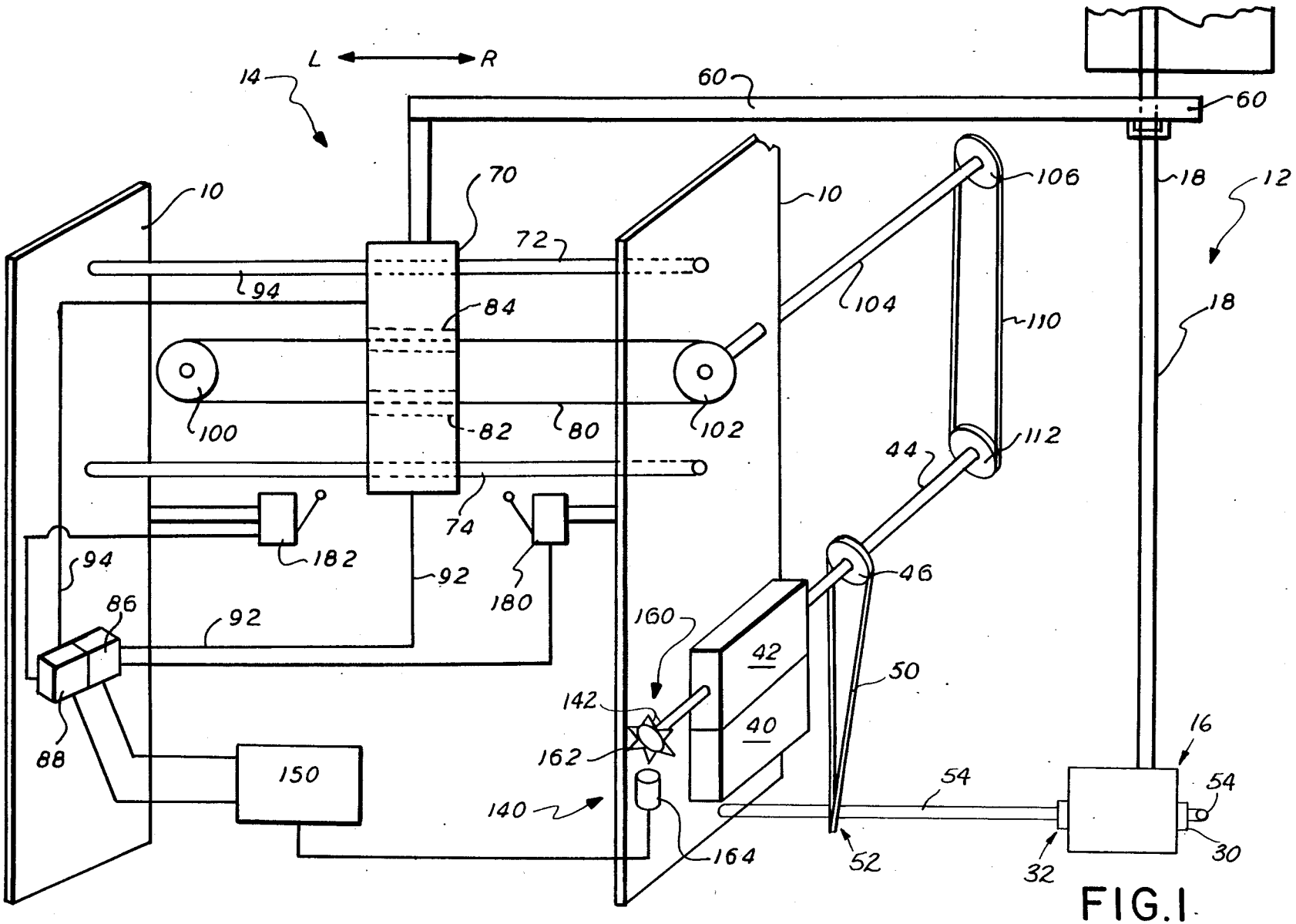
FIG. 1 is a schematic showing in partial isometric to better show details of the essential components of a winding mechanism and traversing mechanism, and controls therefore incorporating the instant invention, all disposed for co-operation with each other to form a multi-layered package of ribbon material.
Figure 2:
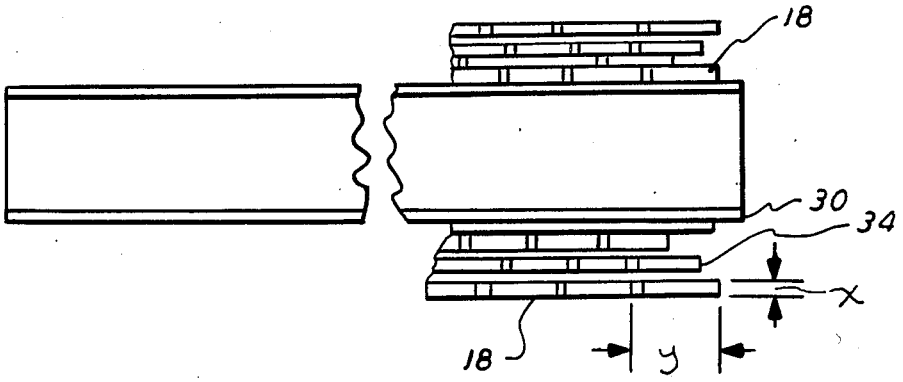
FIG. 2 is a schematic sectional view of a portion of a package of ribbon material layered by the instant invention and showing the edge construction thereof.

With reference to FIG. 1, there is generally shown at 10 a support structure for positioning and supporting the components and assemblies of a package winder 12 and a traversing mechanism 14 which cooperate together to form a package 16 of ribbon-like material 18 (FIGS. 1 and 2). The ribbon of material 18 may be provided to package winder 12 either directly from the equipment upon which material 18 is manufactured; or it may be provided from a bulk supply of material 18. Material 18 is formed and provided in ribbon-like configuration of continuous length and of predetermined thickness "x" (FIG. 2) and width "y". It is wound upon a cylindrical core 30 of cardboard or other suitable and appropriate material to form package 16. It should be noted that the length "l" of core 30 is relatively longer than the width "y" of material 18. Thus, in forming package 16 core 30 is placed on a spindle 32 of package winder 12 and as spindle 32 is driven and traversing mechanism 14 functions (as will be hereinafter explained) material 18 is wound onto core 30 with a number of turns of material 18 forming a layer 34 and a number of layers 34 comprising package 16.

An electric drive motor 40 (FIG. 1) is supported by support structure 10 and suitably connected to electric power and controls. A gear reducer 42, which receives its input drive by suitable and conventional connection to motor 40, provides drive power to a main drive shaft 44 also suitably supported by support structure 10. A timing type pulley 46, connected to and driven by shaft 44 drives spindle timing belt 50 which, in turn, drives another timing pulley 52 connected to and which drives a spindle shaft 54. Spindle shaft 54 is suitably mounted to and by support structure 10 by conventional means such as brackets, journals and the like (not shown) and, in turn, mounts spindle 32 which is of conventional construction and mounted to shaft 54 in a conventional manner.

Core 30, of package 16, is received by and mounted upon spindle 32 to rotate therewith when spindle 32 is being driven by motor 40 through gear reducer 42 shaft 44 pulleys 46, 52, timing belt 50 and spindle shaft 54. Spindle 32 cooperates with core 30 and permits core 30 to be mounted thereon so as to be driven thereby, and so as to be removable therefrom when package 16 has been formed.

A traversing guide 60 cooperates with material 18 to move same back and forth across core 30 and thus to form layers 34 thereon. Guide 60 is guided in its movement by suitable mountings by suitable and conventional guides (not shown) or slide type bushings (not shown) to support structure 10, and is moved in a reciprocatory manner (in the directions of arrows R and L) by a traversing carriage or body 70 of traversing mechanism 14. A pair of guide rods 72, 74, carried by support structure 10, mount traversing body 70 for sliding reciprocatory movement between opposed walls of support structure 10.

Traversing body 70 is of substantially conventional construction and operates in a substantially conventional manner. A carriage drive timing belt 80 extends through and cooperates with traversing carriage 70. This is accomplished by an air-operated clutching mechanisms 82, 84 of conventional construction and operation included in traversing carriage 70, and a pair of solenoid valves 86, 88 which control the passage of pressurized air through conduits 92, 94 respectively to clutching mechanisms 82, 84. Thus, when solenoid valve 86 is operated to permit passage of air through conduit 92 the pressurized air operates clutching mechanism 82 and clutches traversing carriage 70 to timing belt 80 to be moved therewith in the direction of arrow R. When solenoid valve 88 is operated to permit passage of air through conduit 94 the pressurized air operates clutching mechanism 84 and clutches traversing carriage 70 to timing belt 80 to be moved therewith in the direction of arrow L. The construction of clutching mechanisms 82, 84 and their operation by solenoid valves 86, 88 is such that both clutching mechansims are never operated to clutch traversing carriage 70 to belt 80 at the same time. Solenoid valves 86, 88 are suitably connected to electric power and their operation is controlled as will be hereinafter explained.

Timing belt 80 is entrained about and driven by a pair of timing pulleys 100, 102 suitably mounted by suitable and conventional means (not shown) permitting rotation thereof to structure 10. Timing pulley 102 is mounted at one end of a pulley shaft 104 to be driven thereby. Another timing pulley 106 is secured to the other end of pulley shaft 104 and has entrained thereabout a timing belt 110. A timing pulley 112 mounted to shaft 44 receives timing belt 110 and provides drive power thereto.

A shaft rotation sensor 140, mounted proximate an end 142 of main shaft 44, senses the rotation of shaft 44 and provides a digital pulse indication thereof to a two stage counter 150 suitably mounted within support structure 10. Sensor 140 is suitably connected to counter 150 which is, in turn, suitably connected to solenoid valves 86, 88 to control the operation thereof. Sensor 140 includes a sensing wheel 160 with a number of fingers 162 thereon and a sensing head 164 disposed to cooperate with fingers 162 and sense the passage thereof. Thus, as shaft 44 is rotated fingers 162 rotate therewith and as each finger 162 passes sensing head 164 a signal is sent to counter 150. In the instant embodiment there is a finger 162 for each 30 degrees of rotation of shaft 44 but other positioning may be utilized. Similarly, other conventionally available rotation output devices may be utilized.

Two stage counter 150 has a first stage thereof pre-set to deactivate a solenoid valve (either 86 or 88) for a predetermined count to be received from sensor 140. After the count has been received by a second stage of counter 150 the other solenoid valve (either 86 or 88) is activated. Thus, for a predetermined degree of rotation, there is created a dwell during which both solenoid valves are deactivated and no air is moving through conduits 92, 94. Clutching mechanisms 82, 84 are both unactuated and traversing carriage 70 is not clutched to or moved by timing belt 80. It should be remembered, however, that during this dwell spindle 32 is still being driven and so material 18 is being wound onto core 30 but without a traverse or spiral movement.

A first micro-switch 180 is disposed for coaction with traversing carriage 70 and is electrically connected to solenoid valve 86. A second micro-switch 182 is also disposed for coaction with traversing carriage 70 and is electrically connected to solenoid valve 88. Switches 180, 182 are mounted between the spaced members of support structure 10 for selective positioning with respect to traversing carriage 70. They are so disposed to determine the ends of travel of traversing carriage 70 to positions which correspond to the length or core 30. This is to eliminate package edge drift for material 18 due to any inconsistencies in the pitch (traverse distance per revolution) when traversing in one direction and the other direction as will be hereinafter described.

The operator selects the traverse pitch which is usually the width "y" of material 18 plus some clearance for tolerances. The leading edge of material 18 is threaded through guide 60 of traversing mechanism 14 and attached to core 30. Motor 40 is started and winding of material 18 onto core 30 begins. Sensor 140 senses the increment rotations of shaft 44 and sends pulses to stage one of counter 150 which has been pre-set by the operator. When the pre-set count has been reached the particular solenoid valve, for example, 86 is deactivated and its clutch 82 is deactivated. Since clutch 84 is also deactivated traversing carriage 70 stops moving and so does guide 60. Shaft 44 continues to rotate and material 18 is wound but not moved in a traverse direction. Sensor 140 continues to count increments of rotation of shaft 44 and sends same to counter 150 so that at a second pre-set count the second stage counter activates the other solenoid valve, 88, and clutch 84 is actuated and traversing movement of carriage 70 and of material 18 in the other direction begins. The operation continues at the other side of core 30 and so on back and forth until package 16 is finished.

Should the travel of traversing carriage 70, in the direction of either arrow "R" or "L", for whatever reason, continue until carriage 70 engages either micro-switch 180 or 182 respectively, then the operation of the respective micro-switch 180 or 182 will effect operation of either solenoid valve 86 or solenoid valve 88 and deactivate the appropriate clutch 82 or 84 and terminate movement of carriage 70. The operation of shaft 44 will, however, continue and with it the operation of counter 150. When the appropriate count has been attained, as described above, either solenoid valve 86 or 88 (whichever is appropriate) will activate its respective clutch 82, 84, as described above and carriage 70 will again traverse in the appropriate direction.

The described controls for package winding provide an ability to determine rotational position of the package 16 and permits an offset to be selected for each succeeding point of reversal of material 18 upon core 30 at the edge thereof by a predetermined amount of rotational degrees. Thus, a stable edge, such as the one shown for package 16 can be constructed. Such an edge construction has a number of benefits for the purchaser and use of package 16. One such benefit is package 16 has an appearance of quality. Another such benefit is package 16 has stability for shipment and in ultimate use.

From the above description it will thus be seen that there has been provided novel and improved packing equipment and controls therefore.

It is understood that although I have shown the preferred form of my invention that various modifications may be made in the details thereof without departing from the spirit as comprehended by the following claims.

What is claimed is:

1. A control for a traversing mechanism, including a traversing carriage, that is moved in a reciprocatory manner and includes clutch means selectively operated to clutch the traversing carriage to either a first portion of a drive member to be moved in a first direction thereby or to a second portion of the drive member to be moved in a second direction thereby, the traversing carriage in its reciprocatory movements serving to guide a ribbon of material in reciprocatory traverse movement as the material is being wound into a package configuration by a continuously rotating spindle, comprising:

(a) sensor means responsive to the rotation of the spindle to provide indications of incremental rotation thereof;

(b) two stage counter means cooperating with said sensor means to receive said indications of incremental rotation of the spindle therefrom and coacting with the traversing carriage clutch means to activate and deactivate same;

(c) said two stage counter means cooperating with the clutch means following receipt by said counter means from said sensor means of a first predetermined count to de-clutch the clutch means so that the traversing carriage is not clutched to its drive members, and there is a dwell of predetermined rotational duration;

(d) said two stage counter means cooperating with the clutch means following receipt by said counter means from said sensor means of a second predetermined count to actuate the clutch means to clutch the traversing carriage to its drive member for movement thereby in either said first or said second direction thereof;

(e) said two stage counter and said sensor means so cooperating to successively provide said dwells and to clutch said traversing carriage to its drive member for alternating movement in said first and said second directions.

2. The control of claim 1, including micro-switch means disposed in predetermined positions with respect to the reciprocatory movement of the traversing carriage to coact with the traversing carriage and with the clutch means to operate said clutch means to further control declutching of the traversing carriage from its drive member.

3. The control of claim 2, wherein said sensor means includes sensor wheel means attached to the spindle for rotation therewith and sensing head means disposed proximate said sensor wheel means and responsive to the rotation thereof with the spindle to provide said indications of incremental rotation.

4. The control of claim 3, wherein said sensor wheel means includes a plurality of fingers and said sensor head means provides an output count to said two stage counter of the passage of each finger of said plurality of fingers past a predetermined reference.

5. The counter of claim 4, wherein each finger is positioned to correspond to a thirty degree rotation of the spindle.

6. The counter of claim 5, wherein said period of rotation of said dwell is selected by selecting a predetermined setting for said two stage counter.

7. The counter of claim 6, wherein the selected dwell determines the place of reversal of direction of the material being wound by the spindle and a predetermined configuration for the respective edges of a package of the material.

8. The counter of claim 7, wherein said dwells are selected so that the edge configuration of each successive layer of material extends further in the direction of the edge for each such successive layer of material of a first predetermined number of layers of material and then returns to an initial position and repeats.

9. The counter of claim 8, wherein the traversing carriage clutch means is air operated and solenoid valves are provided to control such air operation; said two stage counter means controlling the operation of said solenoid valves.

10. The counter of claim 9, wherein the drive member for the traversing carriage is a timing belt driven by a driven timing pulley and the solenoid valves operate to clutch the traversing carriage to either a first direction of movement of the timing belt or a second direction of movement of the timing belt.

* * * * *